United States Patent [19]

Johnston et al.

[11] 3,953,721

[45] Apr. 27, 1976

[54] ANALOGUE COMPUTER FOR SOLVING POLYNOMIAL EQUATIONS

[75] Inventors: James Stewart Johnston, Bognor Regis; Dennis George Cope, Pagham, both of England

[73] Assignee: Rosemount Engineering Company Limited, Bognor Regis, England

[22] Filed: Feb. 12, 1975

[21] Appl. No.: 549,139

[30] Foreign Application Priority Data

Feb. 19, 1974 United Kingdom ..... 7519/74

[52] U.S. Cl. ..... 235/180; 235/194; 235/151.34

[51] Int. Cl.[2] ..... G06G 7/32; G06G 7/57

[58] Field of Search ..... 235/180, 184, 193, 194, 235/195, 196, 151.34

[56] References Cited

UNITED STATES PATENTS

| | | | |
|---|---|---|---|
| 3,167,649 | 1/1965 | Walp | 235/194 |
| 3,440,411 | 4/1969 | Ragsdale | 235/151.34 |
| 3,443,079 | 5/1969 | Nathan | 235/194 |

*Primary Examiner*—Joseph F. Ruggiero
*Attorney, Agent, or Firm*—Dugger, Johnson & Westman

[57] ABSTRACT

An analogue computer has two or more multiplication modules. Each module provides an output signal representing the product of the magnitude of an analogue input signal to the module and the factor represented by a common multiplier signal controlling the module. Output signals of two or more modules are combined to provide a composite signal. A comparator compares the composite signal with a reference level and adjusts the common multiplier signal so as to maintain the composite signal substantially equal to the reference level. Modules are connected in chains with the output of one module connected to the input of the next module in the chain. Output signals from the various modules represent terms in the polynominal expressions of equations which the computer can solve. Potentiometers allow these output signals to be scaled in accordance with the constant coefficients of the terms. The input of the first module in any chain is fed with a constant reference signal or an analogue signal representing a known or measured variable in the equation. The computer causes the factor represented by the common multiplier signal to represent the unknown variable of the equation.

One example of the computer has two chains each of three modules and calculates the density of a gas from measured values of temperature and pressure.

20 Claims, 5 Drawing Figures

ANALOGUE COMPUTER FOR SOLVING POLYNOMIAL EQUATIONS

BACKGROUND OF THE INVENTION

Figure 1:
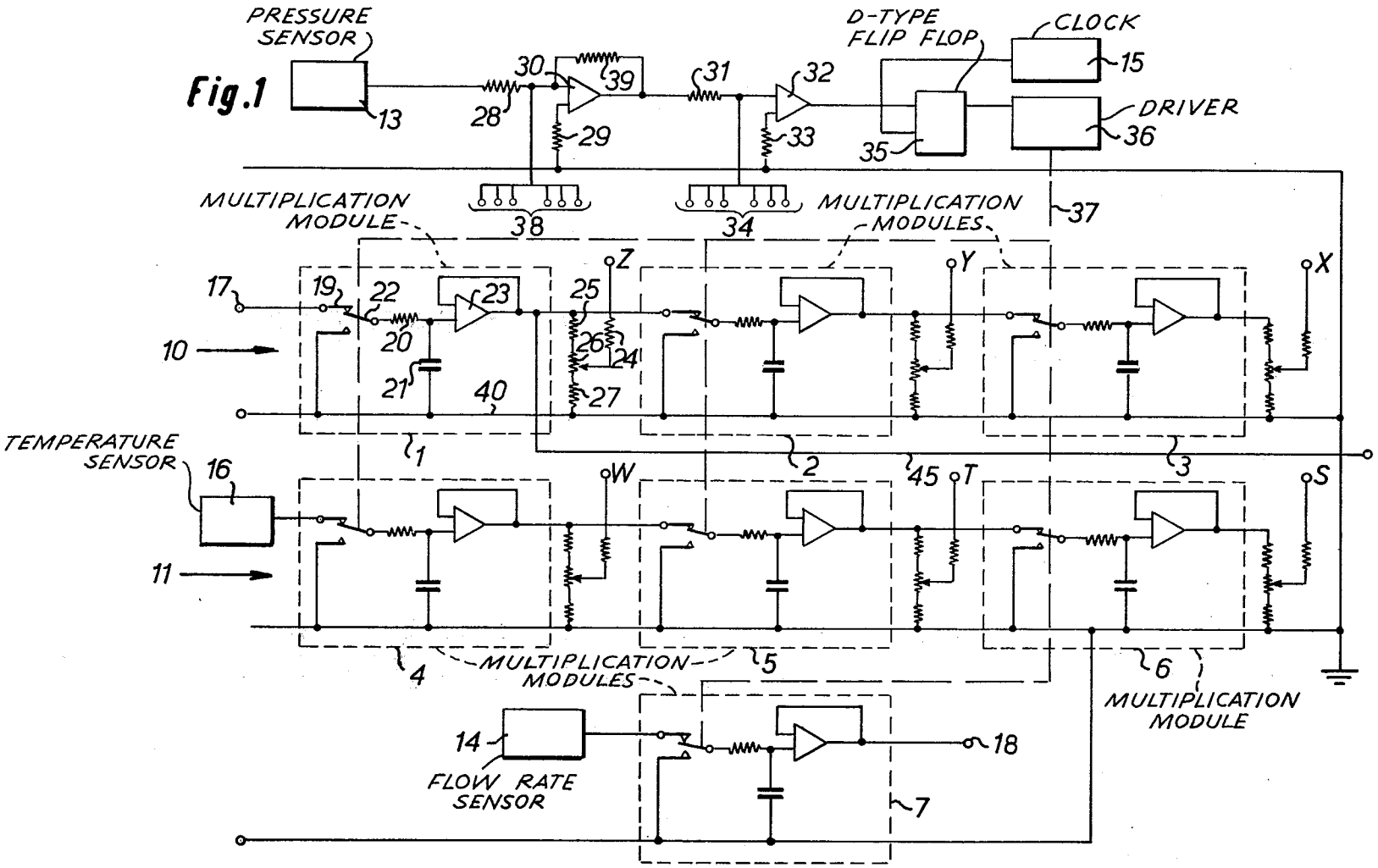

This invention relates to analogue computers. Various forms of analogue computers, particularly for solving differential equations, are well known. However, the automatic solving of non-differential polynominal equations can also be very useful.

For example, it is often necessary to discover the mass flow rate of a gas flowing in a pipe. For this purpose it is necessary to know not only the volume flow rate of the gas but also the density of the gas. The volume flow rate can readily be measured by known means. However, to discover the density of the gas, it is necessary to measure other parameters.

According to Boyles Law, for an ideal gas, $P \alpha Td$, where $d$ is the density P is the absolute pressure and T is the absolute temperature. Real gases deviate from this ideal, but their equations can usually be expressed in the general form;

$$P = f(d,T)$$

By using a digital computer suitably programmed to fit curves to measured sets of data over a required range on various well known gases, it can be demonstrated that these gases all closely fit an equation of the form:

$$P = \pm Ad \pm Bd^2 \pm Cd^3 \pm DdT \pm Ed^2T \pm Fd^3T \qquad 1$$

This equation is transposed to become $$0 = -P \pm Ad \pm Bd^2 \pm Cd^3 \pm DdT \pm Ed^2T \pm Fd^3T \qquad 2$$

$A$, $B$, $C$, $D$, $E$, and $F$ represent positive constants. The values of these constant co-efficients may be ascertained for any particular gas by the above mentioned curve fitting process. The *RHS* of equation (2) for a particular gas is referred to hereinafter as the polynominal expression of the equation of the gas.

In order to discover the density of a gas, the pressure and temperature of the gas may be measured by known means and the equation (1) above solved for density $d$. Clearly, it would be most useful to obtain density $d$ automatically from the measured parameters, temperature $T$ and Pressure P.

More generally, it may often be useful to solve automatically non-differential polynominal equations in which only the variable for which a solution is required is raised to an integral power other than unity. Equations of this type may be expressed generally as follows:

$$0 = A + Bx + Cx^2 + Dx^3 + \ldots + Zx^l + A'a + B'ax + C'ax^2 + D'ax^3 + \ldots + Z'ax^m + A''b + b''bx + C''bx^2 + C''bx^3 + \ldots + Z''bx^n + \ldots$$

where $A, B, C, D, \ldots Z, A', B', \ldots$ etc. are constants, $x$ is the variable for which a solution is required, $a, b, \ldots$ are known variables and $l, m, n \ldots$ are positive integral powers. Equations of this type (referred to hereinafter as polynominal equations of the type described) may contain only a single variable, being the unknown variable $x$, or any number of variables $x, a, b, c \ldots$.

SUMMARY OF THE INVENTION

According to the present invention, there is provided an analogue computer for solving polynominal equations of the type described comprising a high gain comparator means operative to provide a common multiplier signal dependent on the difference between a composite signal and a reference level; at least two multiplication modules, each being responsive to said common multiplier signal to provide a respective analogue output signal which is representative of the product of the magnitude of a respective analogue input signal to the module and the factor represented by said common multiplier signal; and means for combining the analogue signals of at least two said modules to provide said composite signal as a negative feedback input signal to the comparator means, the gain of the comparator means being such that the computer is operative to maintain said composite signal substantially equal to said reference level.

The multiplication modules may be connected in at least one chain, the input signal of any but the first module in the chain being supplied by the output signal of the preceding module in the chain.

It can be seen that the computer operates, because of the high gain of the comparator means, so that only a small difference is required between the composite signal and the reference level to provide the required feedback. It is evident that, in any one chain of modules, output signals are available from the modules which represent successive multiplications of the magnitude represented by the analogue input signal to the first module in the chain by the factor represented by the common multiplier signal. Thus, when the computer is operated, a signal representing either a constant or one of the known variables is supplied as the input signal to the first module in a chain. The output signals of various modules are selected and combined in a suitable manner to represent the polynominal expression of an equation to be solved and supplied as the composite signal to the comparator means. Then the common multiplier signal will be forced to represent the unknown variable in the equation. It can be seen that each selected module output signal corresponds to a term in the polynominal expression of the equation.

It is essential for operation of this computer that a change in the common multiplier signal produces a change in the composite signal in the correct sense to reduce that change in the common multiplier signal, i.e., the composite signal is a negative feedback signal. Only then, can a stable state be achieved. It is well known that polynominal equations of the type described above may, for any set of values of the known variables, have several solutions for the unknown variable. Thus it is also important, for the computer to operate, that the ranges of the values of the known variables are limited to allow only one solution for the unknown variable and also so that, for any set of values of the known variables within these ranges, changes in the unknown variable in a particular sense produce corresponding changes always in a single sense in the composite signal. The composite signal is then suitable supplied to the comparator means to provide negative feedback.

Preferably the output signal combining means include an adjustable scaling means for each module for producing a signal selectively scaled as desired with respect to the output signal of the module, to represent a corresponding term of the equation to be solved. In one embodiment this scaling means conveniently comprises a potentiometer connected to shunt the output signal of the module to earth, the scaled signal being fed from the slider of the potentiometer. Thus, a signal may be produced at each module suitably scaled to represent the corresponding term of the equation, the desired constant coefficient for the term being selected by adjusting the potentiometer.

Preferably also, the combining means further comprise means for adding together those scaled signals representing terms of one polarity in the polynominal expression of the equation and the inverse of those scaled signals representing terms of the other polarity, thereby to provide said composite signal, the relative polarities being chosen to provide negative feedback.

Then, the adding means may include an inverter arranged to provide a signal representing the inverse of the sum of scaled signals representing terms of said other polarity, said inverse sum signal being added to the scaled signals representing terms of said one polarity.

The adding means may be arranged also for adding to the scaled signals at least one signal from a respective analogue signal source. Thus, the polynominal expression represented by said composite signal may include a constant term and terms which are merely the product of a constant and a known variable.

Conveniently the reference level for the comparator means is zero level, in which case it can be seen that the computer operates to make the composite signal representing the polynominal expression of the equation substantially equal to zero.

As a further feature, the combining means may include switching means for selectively switching desired scaled signals for adding together as terms of either said one or said other polarity. This feature enables the computer to be switched into several configurations suitable for solving equations with different terms. However, the computer may be required only to solve equations with the same terms, although the terms may have a range of constant coefficients. In this case, the scaled signals from modules corresponding to the desired terms may be arranged permanently for adding as required. Variations in the coefficient of any selected term may be accounted for by adjusting the respective scaling means.

Clearly, the computer may be employed to great advantage in a control or monitoring system in which a signal is produced corresponding to a desired parameter which is a function of other known or measured parameters. The function must, for the computer to be useful, be expressible as an equation of the type described with the desired parameter as the unknown variable and the measured parameters as the known variables. The signal produced by the computer may be employed either as a measure of the desired parameter for monitoring purposes or to control equipment to operate in response to the value represented by said signal. Such equipment may for example be recording equipment to record the value of the desired parameter or a controller adjusting one or more of the measured parameters to maintain the desired parameter constant at a predetermined value.

Preferably, the common multiplier signal provided by the comparator means is in the form of a time proportioned logic signal, for which the multiplication factor is represented by the fraction of time spent in one of two states. Each multiplication module may then comprise switching circuits giving on-off switching of the analogue input signal to the module and an averaging circuit fed with the switched input signal and providing the analogue output signal of the module.

The timed proportioned logic signal may be a succession of pulses of uniform duration, the mean pulse frequency being controlled by the comparator means. Such a pulse rate signal has the advantage that the pulse rate is proportional to the unknown variable and may therefore be used in a control system to provide the required output information signal. For example, if the unknown variable represents a flow rate, the individual pulses in the pulse rate signal represent unit quantities of flow and may be counted to measure total flow. To provide such a signal, the comparator means may comprise high gain amplifier and, in combination therewith, with an analogue to pulse frequency converter to provide a pulse frequency proportional to the amplitude of the amplifier output. Preferably, however, the comparator means comprises a high gain differential amplifier, having a first input connected to be held at said reference level and an inverting input connected to be supplied with said composite signal, and an analogue to pulse train converter controlled by the output signal of said differential amplifier to provide a train of pulse signals when the reference level exceeds the composite signal. Thus, the composite input signal will automatically be regulated to balance the reference level. The analogue to pulse train converter may comprise a flip-flop with a constant frequency clock pulse signal input, in which case a JK flip-flop is conveniently used with a constant rate clock pulse applied to the clock pulse input and with the output of the high gain amplifier applied to one of the logic inputs and a constant logic one signal applied to the other of the logic inputs. Thus, when the output of the amplifier represents a logic one state, the flip-flop will toggle backwards and forwards at each clock pulse. When the output of the amplifier represents a logic zero, the output of the flip-flop will revert to the zero state at the next clock pulse if it is not already in that condition. It will be seen, therefore, that the output pulses from the flip-flop are of constant duration the duration being determined by the time intervals between the clock pulses, and that the output pulse mean repetition rate, referred to hereinafter as $F_0$, has a maximum value equal to a $\frac{1}{2}F_1$, where $F_1$ is the clock pulse repetition rate.

Conveniently, the switching circuit in each multiplication module comprises two electronic switches, e.g., switching transistors, to one of which is applied as the control signal the aforementioned output of the flip-flop and to the other of which the inverse output is applied as the control signal. Thus, one of these transistors will be switched on for a proportion of the time $F_0/F_1$ and the other will be switched on for a time equal to $(1-F_0/F_1)$. If the first of these switches connects the input signal to the module to the averaging circuit of the module and the second connects a zero level to the averaging circuit then the output signal from the averaging circuit is equal to $F_0/F_1$ times the input signal level. Thus, the unknown variable which is a function of the known variables is represented by the factor $F_0/F_1$.

Alternatively, the time proportioned control signal may be a cyclic signal having the relative duration of the on and off periods controlled in accordance with the difference between the composite signal and the reference level.

In this case, a D type flip-flop may be used in the comparator means instead of the JK flip-flop so that output from the flip-flop will be a logic one following all clock pulses which occur whilst the output from the amplifier represents a logic one. If this output falls to a logic zero, then the flip-flop output will change to and remain at the zero condition.

Instead of a D type flip-flop, to produce a cyclic control signal, the output from the high gain differential amplifier in the comparator means may be applied to a Schmidt trigger circuit so that this circuit, with the composite signal feedback, forms a relaxation oscillator in which the oscillations will have a mark to period ratio proportional to the desired unknown variable.

It has been previously mentioned that the common multiplier signal which is the output of the comparator means is preferably a switching signal time proportioned in a manner to represent the desired solution of the equation for the unknown variable. If an analogue solution signal is required to represent the unknown variable, this may readily be produced. For this purpose, there may be provided an integrating or averaging circuit responsive to said time-proportioned signal to produce an analogue signal representative of the factor represented by said signal. Alternatively, if an analogue signal is required representative of the produce of the unknown variable and a further known variable, there may be provided a further multiplication module responsive to said time-proportioned control signal and having an analogue signal representing said further known variable as the input signal.

As mentioned hereinbefore, one example of a use for the analogue computer is for calculating the density of a gas from the measured parameters, absolute pressure and temperature. Thus, the present invention further envisages, a gas density calculator comprising a pressure sensor for providing an analogue signal representative of the pressure of a gas of which the density is to be calculated, a temperature sensor for providing an analogue signal representative of the temperature of the gas, a high gain comparator means operative to provide a common multiplier signal dependent on the difference between a composite signal and a zero reference level; two chains each of three multiplication modules, each module being responsive to said common multiplier signal to provide a respective analogue output signal which is representative of the product of the magnitude of a respective analogue input signal to the module and the factor represented by said common multiplier signal, the input signals of the second and third modules in each chain being supplied by the output signals of the first and second modules respectively of the respective chain, the input signal of the first module in one chain being a constant reference signal and that of the first module in the other chain being provided by said gas temperature signal, means for combining the output signals of all said modules together with said gas pressure signal to provide said composite signal so as to be representative of the polynominal expression of the equation (as described) for the gas, the composite signal being a negative feed back signal to the comparator means and the gain of the comparator means being such that the computer is operative to maintain said composite signal substantially equal to said zero reference level.

Figure 2:
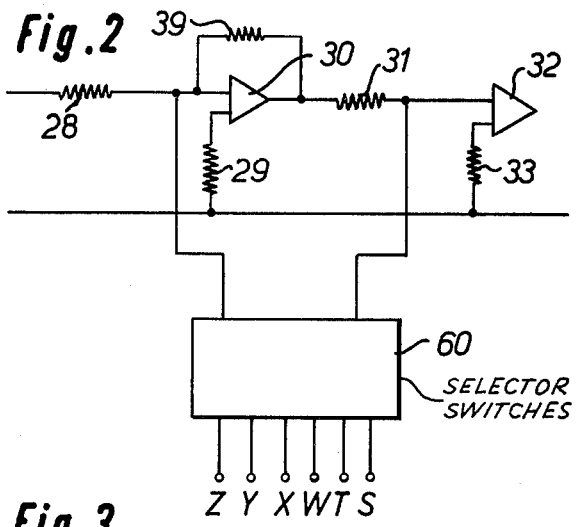
Figure 3:
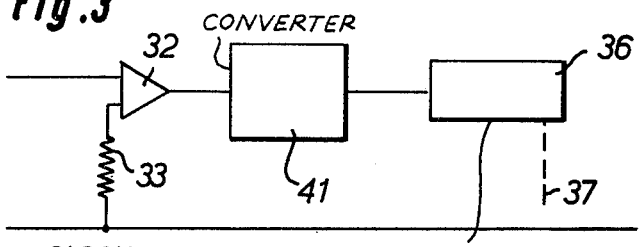
Figure 4:
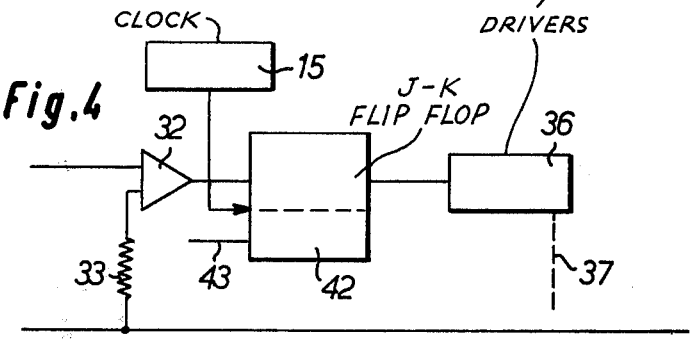
Figure 5:
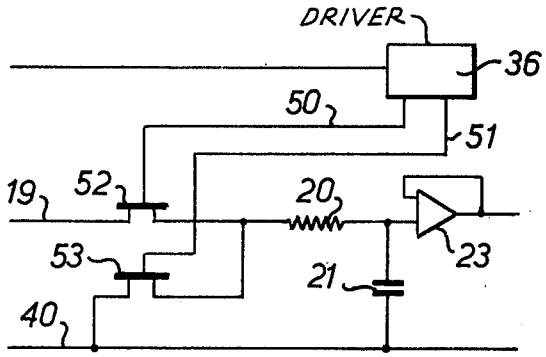

There follows a description of an example of the invention, made with reference to the accompanying drawings in which:

FIG. 1 illustrates diagrammatically a circuit arrangement for a gas density calculator incorporating an embodiment of the analogue computer of the invention, FIG. 2 illustrates a portion of the circuit of FIG. 1 with a switching means for selecting desired multiplication module outputs for combining, FIG. 3 illustrates a different embodiment of comparator means for the circuit of FIG. 1 employing an analogue to pulse frequency converter, FIG. 4 illustrates a further embodiment of comparator means employing a J–K flip-flop, and FIG. 5 illustrates a preferred form of switching circuit for a multiplication module.

Referring to FIG. 1, two chains 10 and 11 of multiplication modules are shown. Each chain contains three such modules, numbered 1, 2 and 3 in chain 10, and numbered, 4, 5 and 6 in chain 11. Modules 1 to 6 are all identical and therefore only module No. 1 will be described in detail. In module 1, an analogue input signal on line 19 is repeatedly switched by a switch 22 to an averaging circuit comprising a resistor 20 and a capacitor 21. The switch 22 operates between one position in which line 19 is connected to resistor 20 and a second position in which resistor 20 is connected to an earth line 40. The switching of the switch 22 in each of modules 1 to 6 is controlled simultaneously by a control signal fed by a line 37 from a switch driver 36. It can be seen that the voltage at the junction of resistor 20 and capacitor 21 will be the voltage of the signal on line 19 multiplied by that fraction representing the amount of the total time that switch 22 is in the position connecting line 19 to resistor 20. The voltage on capacitor 21 is fed to the input of a buffer amplifier 23 which is arranged to be non-inverting and to have a unity gain. The buffer amplifier 23 has a high input impedance and thus isolates capacitor 21 from the effect of any loading. The output of the buffer amplifier 23 provides the analogue output signal of the module.

For the module Nos. 1 and 2 in chain 10 and numbers 4 and 5 in chain 11, the output of the buffer amplifier 23 is fed directly to the input line 19 of the module next in the chain.

For each module, a resistor chain comprising resistors 25 and 27 with an intermediate variable resistor 26 connect the output of the buffer amplifier 23 to the earth line 40. Thus, an output signal is obtained from the slider of potentiometer 26 which can be scaled as required by suitable adjustment of the potentiometer 26. This scaled signal output is fed via a resistor 24 to a terminal Z. The corresponding terminals are referenced Y, X, W, T and S in modules 2, 3, 4, 5 and 6 respectively.

In the calculators an operational amplifier 30 is provided having a non-inverting input connected via a resistance 29 to the earth line. Six terminals 38 are connected directly to an inverting input of the amplifier 30 as is one end of a resistance 28. The purpose and function of resistance 28 together with terminals 38 will be described later herein. The amplifier 30 has a feedback resistance 39 which is arranged to provide unity gain. The output of the amplifier 30 is fed via resistance 31 to the inverting input of a high gain amplifier 32. Six terminals 34 are connected directly to the inverting input of amplifier 32. The non-inverting input of amplifier 32 is connected to the earth line via resistance 33. The function of the high gain amplifier 32 in co-operation with terminals 34 and amplifier 30 will be further described below.

The gain of the amplifier 32 is sufficiently high that, for only a small change in input, its output swings between two levels representing logic "0" and logic "1."

This output of amplifier 32 is fed to the logic input of a D type flip-flop 35 which is clocked at a constant frequency $F_o$ by pulses from a clock 15. The clock 15 may be any known type such as an astable multivibrator, provided the period $1/F_o$ between pulses is short compared with the time constant of the averaging circuit 20, 21 in each module. When the logic input of flip-flop 35 is a "1," the output switches to a logic "1" after the first clock pulse and when the logic input is a "0" it switches to a logic "0" after the first clock pulse. This output of the flip-flop 35 is fed to the switch driver 36 which provides control signals corresponding to the output of the flip-flop to drive the switches 22 in the multiplication modules.

In operation, the circuit of the figure may be used to solve the gas equation (2) (referred to hereinbefore) for the density *d* in the following manner. A constant reference voltage $V_{REF}$ is applied to a terminal 17 providing an input signal on line 19 of the module No. 1 in chain 10. A temperature sensor 16 provides a voltage (Temp) proportional to the absolute temperature (T) of the gas whose density is to be calculated. This voltage (Temp) is applied to input 19 of the module No. 4 of chain 11. The other measured parameter of the gas under observation is the absolute pressure and a voltage proportional to such pressure is provided by a pressure sensor 13 and applied to the resistance 28 for feeding thereby to the input amplifier 30. If f is the factor represented in a time proportioned manner by the control signal on line 37, then it can be seen that the signals available at terminals Z, Y and X are $Af V_{REF}$, $Bf^2{}_{REF}$ and $Cf^3 V_{REF}$ respectively, or written another way.

$Z \alpha Af$, $Y \alpha Bf^2$, $X \alpha Cf^3$, with the same proportionality factor.

Similarly it can be shown that the signals available from terminals W, T and S are D Temp.$f$, E Temp.$f^2$ and F Temp.$f^3$ respectively, or written another way $$W \alpha D\,T.f,\ T \alpha E\,T.f^2,\ S \alpha F\,T.f^3.$$

If $V_{REF}$ = Temp/$T$ the same constant of proportionality applied for the signal at each terminal. The co-efficients A, B, C, D, E and F are adjustable by the potentiometer 26 in each module. Thus, in order to simulate the equation (2) for the particular gas being measured, scaling factors corresponding to the value of the respective co-efficients as calculated in the curve fitting process described before are applied by the respective potentiometers 26. Then, the terminal corresponding to each term in the equation is connected to one of either terminals 34 or terminals 38 depending on whether that term is positive or negative respectively in the equation.

The resistors 24 are of equal magnitude to each other and also of equal value to the feedback resistor 39 of amplifier 30 and so the output of the amplifier 30 is the inverse of the sum of all those signals connected to terminals 38 plus the voltage proportional to absolute pressure applied to resistor 28. Also, the magnitude of resistance 31 connecting the output terminal of the inverter to the inverting input terminal of the high gain amplifier 32 is the same as that of resistance 24. Thus, the input signal to amplifier 32 will be a composite signal representing the sum of all the signals connected to terminals 34 plus the output of inverter 30. Therefore, it can be seen that potentiometers 26, with resistors 25 and 27 for the six multiplication modules, resistors 24, inverting amplifier 30 with feedback resistor 39 and resistor 31 together constitute combining means providing the composite signal.

This composite input of amplifier 32 is a signal representing the sum of all the positive terms (aplied to terminals 34) of the polynominal expression of equation (2) minus the sum of all the negative terms (applied to terminals 28) and the absolute pressure to resistor 28). It will be noted that an increase in the density of a gas, other than at an inter-phase point, requires an increase in pressure. Thus, in the right hand side of any equation (2) representing a gas, if P and T are constant, an increase in *d* produces an increase in the value of the right hand side. In the same way, a change in the control signal on line 37 representing an increase in d produces an increase in the value represented by the composite signal applied to the inverting input of amplifier 32. Since the non-inverting input of amplifier 32 is connected via resistance 33 to the earth line, the negative feedback causes the circuit to force the composite input signal to amplifier 32 to be substantially at the same level as earth. As a result the control signal on line 37 is forced to be time proportioned to represent the solution of the gas equation for the density *d.*

It will be noted that the output signal from either terminal Z or directly from the output of the buffer amplifier 23 of module 1, as provided by a line 45 is an analogue signal proportional to the density.

However, it may be required to produce an analogue signal representative of the product of the density and further measured parameter for the gas. In this case (as shown in FIG. 1) a further multiplication module 7 is employed controlled by the signal on line 37 as before. The input signal is an analogue signal representing said further measured parameter of the gas as provided by a sensor 14. The further parameter may be the gas flow rate and the result of multiplying the gas flow rate by the density of the gas flowing at any time provides a signal at an output terminal 18 of the module 7 representing the mass flow rate at this time.

Commonly, however, gas flow rates are obtained by measuring the pressure drop across an orifice plate or a pitot tube, in which case such a pressure drop is proportional to the product of the density and the square of the flow velocity. Thus, if a signal representing such a pressure difference is applied as the input of the further multiplication module 7, the output signal will be proportional to the square of the product of density and flow velocity. In order to obtain a signal representing mass flow rate, it is necessary to extract the square root of this output signal.

In another example the gas flow rate may be measured by a metering device giving a signal whose frequency represents the flow rate. Such devices include turbine meters, positive displacement meters and vortex shedding devices. When using such devices, the clock pulses for the D-type flip-flop 35 may be derived from the frequency output signal of the device, in which case the clock 15 referred to above is replaced by the flow-meter. Then, a signal with a frequency proportional to both the flow rate and the density and, thus, representing mass flow rate may be produced by gating the switching output signal of the D-type flip-flop with the clock signal in an AND gate. The output signal from the AND gate may be used directly for totalising mass flow.

In the calculator described with reference to FIG. 1, it is proposed to connect between terminals S, T, W, X, Y and Z and desired ones of terminals 34 and 38 by direct wiring. However, greater flexibility may be achieved by providing switching means 60 (FIG. 2) allowing selective switching of scaled signals from terminals S, T, W, X, Y and Z as desired for feeding to one of the amplifiers 30 and 32.

Instead of the D type flip-flop 35, an analogue to pulse frequency converter 41 may be provided (FIG. 3). This converter 41 generates standard pulses at a rate dependent on the output of the amplifier 32.

In another embodiment as shown in FIG. 4, the D-type flip-flop 35 is replaced by a J-K type flip-flop 42. Then one logic input of the J-K flip-flop 42 is fed with the output signal from amplifier 32 and the other logic input 43 is held at a logic '1.'

In a still further embodiment, the output of amplifier 32 is fed to a Schmitt trigger circuit instead of the converter 41. The output signal of the Schmitt trigger then provides the time-proportioned signal.

Referring to FIG. 5, a preferred form of switching circuit for each of the multiplication modules has two F.E.T. switching transistors 52 and 53. Transistor 52 is controlled by a signal fed on a line 50 from switch driver 36 and corresponding with the time-proportioned signal. Transistor 53 however, is controlled by a signal fed on a line 51 from switch driver 36 and corresponding to the inverse of the time proportional signal. Thus, resistor 20 is alternately connected in series with the input line 19 of the module and the earth line 40.

It will be apparent that the described calculator has numerous applications other than for the measurement of gas densities from temperature and pressure readings. For example, a similar device might be used for measuring the density of liquids. Pressure changes would have little effect with liquids, however, and a constant reference voltage may be applied to resistance 28 instead of the voltage proportional to absolute pressure. Also it can be demonstrated that for liquids absolute temperature and density may be related in an equation of the form:

$$0 = -K + AdT + BD^2T + Cd^3T,$$

where $K$, $A$, $B$ and $C$ are constants. Therefore, only a single chain of multiplication modules are required to provide signals representing the terms $AdT$, $Bd^2T$ and $Cd^3T$ of the equation. The values of the constants $A$, $B$, $C$ and $K$ may be established using the curve fitting process described above.

Clearly, more complicated equations of the type described may be solved with analogue computers within the scope of this invention by employing further module chains corresponding to further known variables appearing in the equation as multipliers of integral powers of the unknown variable and by employing further modules in any chain to provide terms with higher integral powers of the unknown variable.

A general purpose analogue computer may be provided for solving a variety of equations. In which case a number of chains of modules are provided, each chain comprising several modules. For each module, scaling means are provided corresponding to potentiometer 26 and resistors 25, 27 in the accompanying drawings. Term selector switches are provided enabling each of the scaled signals from the modules to be selected for feeding via resistors corresponding to resistor 24 to either of two sets of terminals corresponding to terminals 34 or 38. The number of each such terminals sets is the same as the total number of modules in the computer.

However, a computer may be constructed to suit a particular function, in which case the minimum number of chains and modules are provided and the scaled outputs are permanently connected via resistors corresponding to resistor 24 to the desired terminals 34 or 38.

We claim:

1. An analogue computer for solving polynominal equations of the type described comprising a high gain comparator means operative to provide a common multiplier signal dependent on the difference between a composite signal and a reference level; at least two multiplication modules, each module being responsive to said common multiplier signal to provide a respective analogue output signal which is representative of the product of the magnitude of a respective analogue input signal to the respective module and the factor represented by said common multiplier signal; and means for combining the analogue output signals of at least two said modules to provide said composite signal as a negative feedback input signal to the comparator means, the gain of the comparator means being such that the computer is operative to maintain said composite signal substantially equal to said reference level.

2. An analogue computer as claimed in claim 1 wherein the output signal combining means includes an adjustable scaling means for each module for producing a signal selectively scaled as desired with respect to the output signal of the module, so as to represent a corresponding term of the equation to be solved.

3. An analogue computer as claimed in claim 2 wherein each scaling means comprises a potentiometer connected to shunt the output signal of the module to earth, the scaled signal being fed from the slider of the potentiometer.

4. An analogue computer as claimed in claim 2 wherein the combining means further comprises means for adding together those scaled signals representing terms of one polarity in the polynominal expression of the equation and the inverse of those scaled signals representing terms of the other polarity, thereby to provide said composite signal, the relative polarities being chosen to provide negative feedback.

5. An analogue computer as claimed in claim 4 wherein the adding means includes means for adding to the scaled signals at least one signal from a respective analogue signal source.

6. An analogue computer as claimed in claim 1 wherein the multiplication modules are connected in at least one chain, the input signal of any but the first module in the chain being supplied by the output signal of the preceding module in the chain.

7. An analogue computer as claimed in claim 4 wherein the combining means further comprises switching means for selectively switching desired scaled signals for adding together as terms of either said one or said other polarity.

8. An analogue computer as claimed in claim 4 wherein the adding means includes an inverter arranged to provide a signal representing the inverse of the sum of scaled signals representing terms of said other polarity, said inverse sum signal being added to the scaled signals representing terms of said one polarity.

9. An analogue computer as claimed in claim 1 wherein the comparator means is arranged to provide a common multiplier signal in the form of a time proportioned logic signal, for which the multiplication factor is represented by the fraction of time spent in one of two states.

10. An analogue computer as claimed in claim 9 wherein each of the multiplication modules comprises a switching circuit giving on-off switching of the analogue input signal to the module and an averaging circuit fed with the switched input signal and providing the analogue output signal of the module.

11. An analogue computer as claimed in claim 10 wherein the comparator means are arranged such that the time proportioned logic signal is a succession of pulses of uniform duration, the mean pulse frequency being controlled by the comparator means.

12. An analogue computer as claimed in claim 11 wherein the comparator means comprise a high gain amplifier and, in combination therewith, an analogue to pulse frequency converter to provide a pulse frequency proportional to the amplitude of the amplifier output signal.

13. An analogue computer as claimed in claim 11 wherein the comparator means comprise a high gain differential amplifier, having a first input connected to be held at said reference level and a second input connected to be supplied with said composite signal, and an analogue to pulse train converter controlled by the output signal of said differential amplifier to provide a train of pulse signals when the reference level exceeds the composite signal.

14. Analogue computer as claimed in claim 13 wherein the analogue to pulse train converter comprises a JK flip-flop arranged to be clocked at a constant rate and having the output signal of the high gain differential amplifier supplied to one of the logic inputs and a constant logic "1" signal supplied to the other of the logic inputs.

15. An analogue computer as claimed in claim 10 wherein the comparator means are arranged such that the time proportioned logic signal is a cyclic signal having relative durations in two states controlled in accordance with the difference between the composite signal and the reference level.

16. An analogue computer as claimed in claim 15 wherein the comparator means comprise a high gain differential amplifier, having a first input connected to be held at said reference level and a second input connected to be supplied with said composite signal, and a D-type flip-flop arranged to be clocked at a constant rate and having a logic input supplied with the output signal of the differential amplifier.

17. An analogue computer as claimed in claim 15 wherein the comparator means comprise a high gain differential amplifier, having a first input connected to be held at said reference level and a second input connected to be supplied with said composite signal, and a Schmidt trigger circuit supplied with the output of the differential amplifier.

18. An analogue computer as claimed in claim 9 and including an averaging circuit responsive to said time proportioned logic signal to produce an analogue signal representative of the factor represented by said common multiplier signal.

19. An analogue computer as claimed in claim 9 wherein at least one said respective analogue input signal to a module is a reference signal representing a constant value and having means supplying the corresponding analogue output signal of the module as an analogue signal representing said factor.

20. A gas density calculator comprising a pressure sensor for providing an analogue signal representative of the pressure of a gas of which the density is to be calculated, a temperature sensor for providing an analogue signal representative of the temperature of the gas, a high gain comparator means operative to provide a common multiplier signal dependent on the respective difference between a composite signal and a zero reference level; two chains each of three multiplication modules, each module being responsive to said common multiplier signal to provide a respective analogue output signal which is representative of the product of the magnitude of a respective analogue input signal to the module and the factor represented by said common multiplier signal, the input signals of the second and third modules in each chain being supplied by the output signals of the first and second modules respectively of the respective chain, the input signal of the first module in one chain being a constant reference signal and that of the first module in the other chain being provided by said gas temperature signal, means for combining the output signals of all said modules together with said gas pressure signal to provide said composite signal so as to be representative of the polynominal expression of the equation, the composite signal being a negative feed back signal to the comparator means and the gain of the comparator means being such that the computer is operative to maintain said composite signal substantially equal to said zero reference level.

* * * * *

UNITED STATES PATENT AND TRADEMARK OFFICE

CERTIFICATE OF CORRECTION

PATENT NO. : 3,953,721

DATED : April 27, 1976

INVENTOR(S) : James Stewart Johnston, Dennis George Cope

It is certified that error appears in the above-identified patent and that said Letters Patent are hereby corrected as shown below:

Column 2, line 10, after "analogue" insert --output--.

Column 12, line 34, change "module" to --respective module--.

Column 12, line 46, after "equation" insert --relating the density with the absolute pressure and temperature of the gas, which polynomial expression is produced by transposing all terms of said equation to one side, the other side being zero--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*